United States Patent [19]

Garnett

[11] 4,141,408

[45] Feb. 27, 1979

[54] SUPPLEMENTARY HEAT CONTROL FOR HEAT PUMP SYSTEM

[75] Inventor: Jack V. Garnett, Fort Smith, Ak.

[73] Assignee: Rheem Manufacturing Company, New York, N.Y.

[21] Appl. No.: 696,646

[22] Filed: Jun. 16, 1976

[51] Int. Cl.[2] ..... F25B 29/00

[52] U.S. Cl. ..... 165/29; 236/1 E; 219/364; 219/486

[58] Field of Search ..... 165/29; 236/1 E; 62/324; 219/364, 486, 487

[56] References Cited

U.S. PATENT DOCUMENTS

| | | | |
|---|---|---|---|
| 2,498,861 | 2/1950 | Newton | 62/324 |
| 3,006,613 | 10/1961 | Coyne | 165/29 |
| 3,127,930 | 4/1964 | Tenniswood | 165/29 |
| 3,167,114 | 1/1965 | Swart | 165/29 |
| 3,261,395 | 7/1966 | Foster | 165/29 |
| 3,318,372 | 5/1967 | Shell | 165/29 |
| 3,385,349 | 5/1968 | MacLeod | 165/29 |
| 3,444,923 | 5/1969 | Kyle | 165/29 |
| 3,588,471 | 6/1971 | Chambers | 219/486 |
| 3,867,979 | 2/1975 | Carrasse | 165/29 |

*Primary Examiner*—Ronald H. Lazarus
*Assistant Examiner*—Margaret LaTulip
*Attorney, Agent, or Firm*—Allegretti, Newitt, Witcoff & McAndrews

[57] ABSTRACT

A supplementary heat control for a heat pump system includes thermostatic sensors on the downstream side of the heat pump heating coil. The sensors upon sensing temperature differentials in the heated air stream which indicate the need for supplemental heat operate relays. The relays, in turn, activate power input to supplementary heating coils downstream from the thermostatic sensors. A plurality of sensors are disclosed for sensing differential temperature differentials and thus permitting staging of supplementary heat.

2 Claims, 1 Drawing Figure

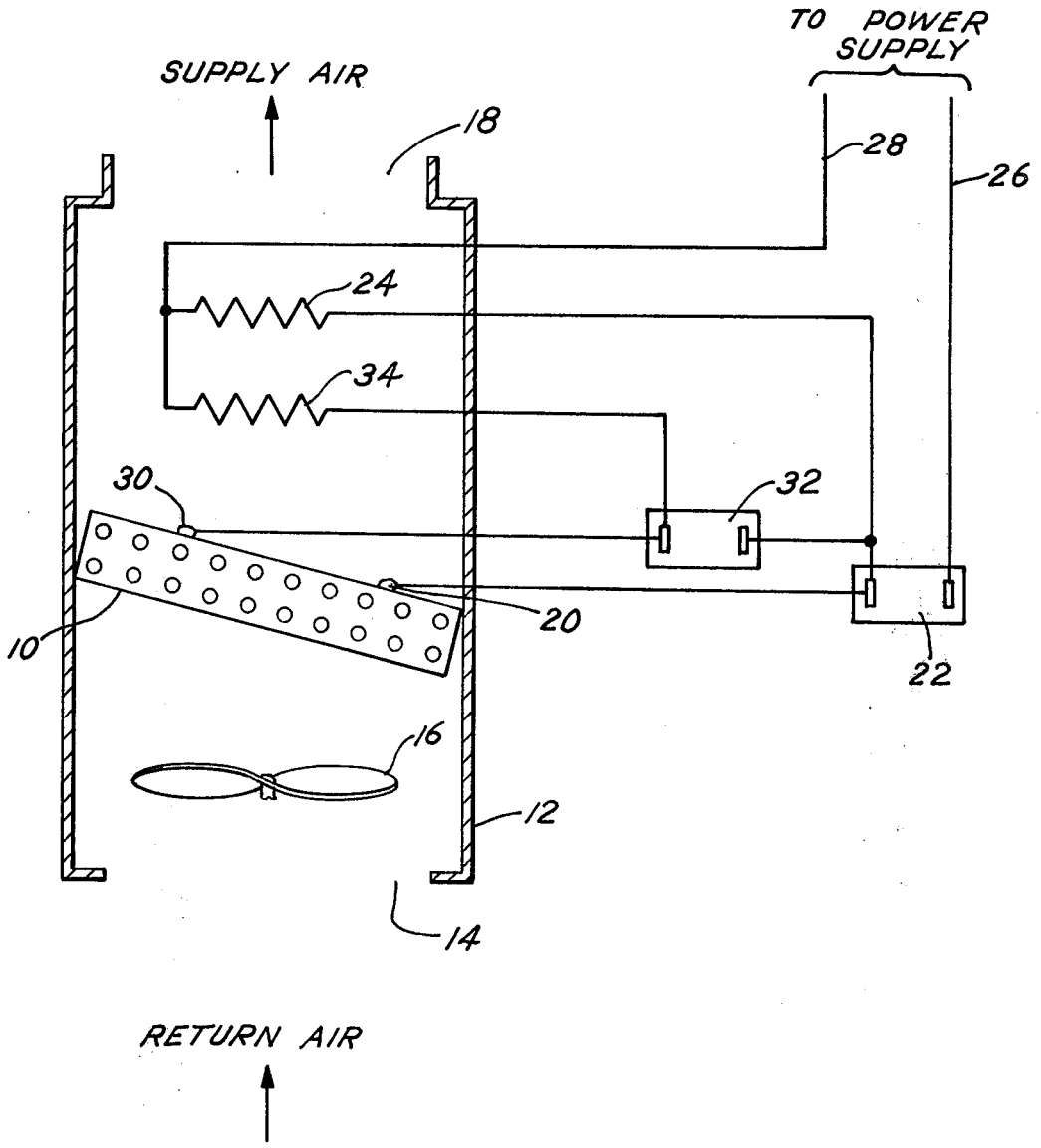
TO POWER SUPPLY
SUPPLY AIR
18
28
26
24
34
30
32
20
10
22
16
12
14
RETURN AIR

SUPPLEMENTARY HEAT CONTROL FOR HEAT PUMP SYSTEM

BACKGROUND OF THE INVENTION

In a principal aspect, the present invention relates to an improved supplementary heat control for a heat pump system and more particularly to a supplementary control adapted to sense heat requirements and initiate input of supplementary heat to the system.

Heat pump systems are popular in regions of the country wherein temperature extremes, particularly cold temperature extremes, do not frequently occur. When in the heating cycle, the condensor coil of a heat pump assembly is utilized to discharge heat into a moving air stream. Thus, cool air is withdrawn from the enclosure, is heated by passage over the condensor coil and is subsequently ejected into the enclosure.

Whenever heating demand exceeds the capacity of the heat pump, supplementary heat must be provided to the air stream. Such supplementary heat may be provided by any of a number of sources, including electric resistance heat, hot water heat, a fossil fuel source, a fired heat exchanger or other available sources. Commonly, the need for supplementary heat is sensed and the control of such heat is provided by thermostatic control means situated in the enclosure being heated. Alternatively, the temperature outside the enclosure is sensed and compared in some fashion with the temperature in the enclosure to determine whether a supplementary heat source must be utilized. Such arrangements often are complex and require a skilled craftsman for installation.

Thus, an apparatus and method which provides control for variable supplementary heat requirements is desired. Additionally, a system which eliminates the need for outside thermostats and wiring is needed. Finally, a supplementary heat control system which will facilitate and improve the warm-up capability of a heat pump system is desirable.

SUMMARY OF THE INVENTION

Briefly, the present invention relates to a supplementary heat input control system for a heat pump wherein a thermostatic control is placed downstream from the condensor coil for the heat pump and upstream from the supplementary heat source so that the air or coil temperature of the heat pump derived from the heater or condensor coil will be sensed, thereby giving an indication of the supplementary heat requirements. The thermostatic sensor operates relay means to control supplementary heat sources such as an electric resistance heater. A plurality of sensors may be utilized to control separate supplementary heat devices. Thus, staging of the supplementary heat sources is possible.

It is thus an object of the present invention to provide an improved method for control of supplementary heat in a heat pump system.

It is a further object of the present invention to provide an improved supplementary heat control system for a heat pump system.

Still another object of the present invention is to provide a supplementary heat control system for a heat pump system wherein a plurality of supplementary heat stages may be separately controlled in response to the temperature of the output air associated with the condensor coil of the heat pump.

These and other objects, advantages and features of the invention will be set forth in greater detail in the description which follows.

BRIEF DESCRIPTION OF THE DRAWING

In the detailed description which follows, reference will be made to the drawing comprised of a single FIGURE illustrating, in schematic form, the improved method and apparatus of the present invention.

DESCRIPTION OF THE PREFERRED EMBODIMENT

In the FIGURE, a condensor coil 10 of a heat pump system is illustrated. The total heat pump system is not illustrated since such systems are well known to those skilled in the art. The coil 10 is positioned within an air passage 12. Return air from the enclosure being heated passes through a return air inlet 14 and is driven by a fan 16 or similar air moving device through passage 12 over coil 10 for discharge through outlet 18. Air from the outlet 18 is supply air to the enclosure being heated. In a heat pump device (not shown), the indoor coil 10 is the condensor coil 10 during the heating cycle.

A first stage sensor or thermostatic device 20 is positioned in the passage 12 on the downstream side of coil 10. Alternatively sensor 20 may be attached to the coil 10 to sense the temperature thereof. The sensor or thermostatic device 20 operates a relay 22. Relay 22 is a normally open relay. Relay 22 is closed in response to an appropriate signal from sensor 20. Closing relay 22 completes a circuit through resistance heater 24 from power supply lines 26 and 28.

A second sensor 30 is also positioned on the downstream side of coil 10 or attached to coil 10. Second sensor 30 operates normally open relay 32. Closing relay 32 permits power to the supplementary resistance heater 34. Note that the heaters 24 and 34 are downstream from the sensors 20 and 30.

Relays 22 and 32 are in series with respect to heater 34, thus requiring closure of both relays 22 and 32 before heater 34 becomes operative. In this way, supplementary heat input to the air flowing through passage 12 is controlled in stages. That is, a first low temperature differential sensed by sensor 20 initiates operation of heater 24. If a second higher temperature differential persists, both sensors 20 and 30 cause operation of heaters 24 and 34 simultaneously. Heater 34 operates only if heater 24 is operating in the embodiment shown. Other circuit patterns may be provided to control operation of the heaters 24, 34 in required sequence.

The relays 22 and 32 may also be interlocked with the thermostatic control for the enclosure being heated. That is, the power supply through lines 26 and 28 may be shut off by the enclosure thermostat, except upon indication of heat demand by that thermostat (not shown). Additionally, further supplementary heat stages may be used with the staging arranged in the fashion disclosed.

Various types of sensors 20 and 30 may also be used. Such sensors may be a modulating type or a on-off control type. The supplementary heat source may be varied. For example, a hot water heat source may be utilized wherein the sensors would control valve mechanisms.

With the structure of the present invention, the amount of supplementary heat can be closely controlled and made directly dependent upon existing conditions including the efficiency of the heat pump, the ambient air temperature outside the enclosure being heated, the heat loss of the structure being heated and the temperature of the enclosure or structure being heated. Because of the straightforward design, the supplementary controls may be installed and wired at the factory locations, thus lowering cost. Complex on-site wiring is not longer required with the present invention. Also, the supplementary heat will not be used until the output of the heat pump is less than the heat loss of the structure being heated. Thus, while in the foregoing there has been set forth a preferred embodiment of the invention, it is to be understood that the invention is to be limited only by the following claims and their equivalents.

What is claimed is:

1. In a heat pump system, the improvement of apparatus for controlling supplementary heat input into the heating cycle of the heat pump system, said system of the type having a cool air inlet, a warm air outlet, a heating coil intermediate the inlet and outlet, and means for moving air from the inlet over the coil to the outlet, said apparatus comprising in combination:

at least two thermostatic sensors at the downstream side of said coil between the inlet and outlet, and auxiliary heat means associated with each sensor downstream from said associated thermostatic sensor between the inlet and outlet, control means operative in response to a signal from each thermostatic sensor means, said auxiliary heat means arranged in parallel, and said control means arranged in series to sequentially control the auxiliary heat means and provide supplemental heat to air flowing over the coil between the inlet and outlet.

2. The improved apparatus of claim 1 wherein the thermostatic sensors are set to detect discrete temperature differences before operating their respective control means, the temperature difference for each successive sensor being greater than that of the subsequent sensor.

* * * * *